United States Patent [19]

Fukada et al.

[11] 4,429,002

[45] Jan. 31, 1984

[54] BULKY NON-WOVEN FABRIC OF POLYBUTYLENE TEREPHTHALATE CONTINUOUS FILAMENTS

[75] Inventors: Shunsuke Fukada, Kusatsu; Kiyoshi Aihara, Otsu; Hideo Ibaragi, Omihachiman, all of Japan

[73] Assignee: Toray Industries, Inc., Tokyo, Japan

[21] Appl. No.: 460,617

[22] Filed: Jan. 24, 1983

Related U.S. Application Data

[63] Continuation of Ser. No. 271,221, Jun. 8, 1981, abandoned.

[30] Foreign Application Priority Data

Jun. 13, 1980 [JP] Japan ..... 55-78921

[51] Int. Cl.[3] ..... B32B 27/34; D04H 1/04

[52] U.S. Cl. ..... 428/287; 28/247; 28/254; 28/262; 428/288; 428/296

[58] Field of Search ..... 428/287, 288, 296; 28/247, 254, 262

[56] References Cited

U.S. PATENT DOCUMENTS 4,129,675 12/1978 Scott ..... 428/296

*Primary Examiner*—Marion McCamish

*Attorney, Agent, or Firm*—Wegner & Bretschneider

[57] ABSTRACT

Non-woven fabric comprising polybutylene terephthalate continuous filaments having a three-dimensional crimp of unfixed shape provides remarkable resiliency, flexibility, and strength. A method of manufacturing such non-woven fabric forms a blended yarn of polybutylene terephthalate continuous filaments and highly shrinkable continuous filaments having a low melting point through direct coupling with high speed take-off means, and subjecting the resultant web to a relax heat set.

21 Claims, 5 Drawing Figures x2

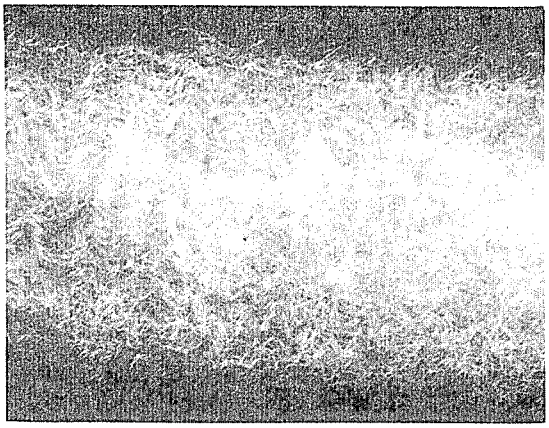
FIG. 1 X2
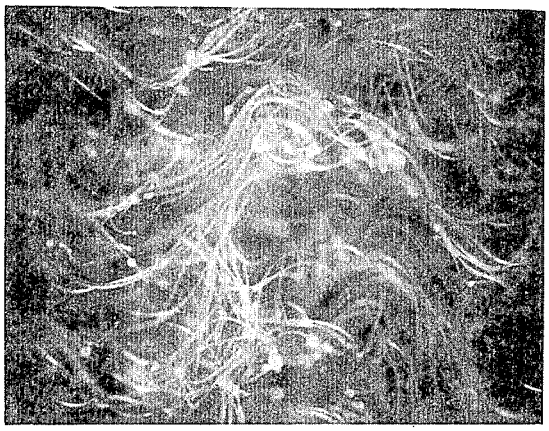
FIG. 2 X40

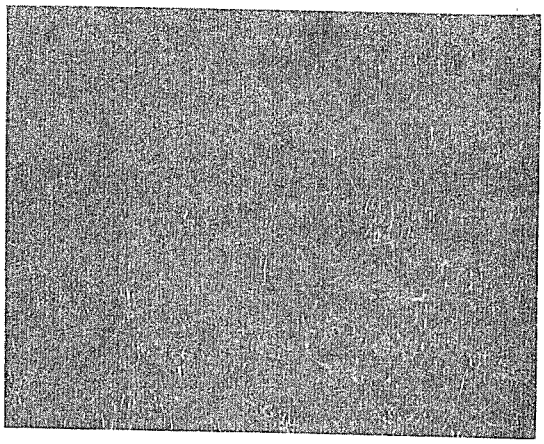
FIG. 3 X 2.5

BULKY NON-WOVEN FABRIC OF POLYBUTYLENE TEREPHTHALATE CONTINUOUS FILAMENTS

This application is a continuation application of U.S. application Ser. No. 271,221, filed June 8, 1981 now abandoned.

BACKGROUND OF THE INVENTION

Continuous filament non-woven fabric has remarkably high strength and favorable dimensional stability as compared with short fiber non-woven fabric. Moreover, it can be produced through direct coupling with the spinning process resulting in an appreciable cost reduction.

Conventional continuous filament fabrics are coarse or rough and stiff having a paper-like appearance, because web making through direct coupling with spinning does not provide an opportunity for imparting the crimp to the constituent filaments in order to develop the desirable bulkiness. A conventional method used to provide crimping after forming the web is to preliminarily impart a latent crimp to the web through conjugate spinning or the like. However, this method does not develop sufficient bulkiness, because in a continuous filament web, the crimp tends to be overlapped in its phase and the binding force among the filaments is extremely strong.

Another method of forming the web is through simultaneously separating the filaments and imparting a crimp by causing filaments taken off at high speeds to reflect or turn with a baffle or a impinge plate. This practice is disadvantageous in that not only is sufficient crimping difficult to obtain, but the filaments are not readily separated. The consequent difficulties in making the bulkiness and the uniformity of the web compatible result in a product with inferior strength.

Furthermore, the use of polyethylene terephthalate filaments or nylon filaments in the above-described methods renders it impossible in such methods to simultaneously obtain remarkable flexibility and bulkiness.

Continuous filament non-woven fabric, therefore, has been strongly restricted thus far in the development of applications in industries and for apparel items in which high heat insulation and flexibility are required.

SUMMARY OF THE INVENTION

Non-woven fabric according to the present invention comprises polybutylene terephthalate (PBT) continuous filaments randomly disposed so as to be laminated and bonded having an apparent density less than 0.7 g/cc under a load at 0.5 g/cm$^2$ and a three-dimensional crimp of unfixed shape with a crimp extensibility greater than about 5%. The crimp may be oriented in the direction of its thickness. In a preferred embodiment, the bonding component of PBT copolymer has a polybutylene terephthalate unit of about 30 to about 80 mol % and a melting point from 110° to 190° C. The PBT polymer may be composed of a polybutylene terephthalate unit greater than about 70 mol %, or, preferably, greater than about 90 mol %. The continuous filaments and the bonding component in a preferred embodiment have greater than a 30° C. difference between their respective melting points. The non-woven fabric may have a weight of about 10 to about 2,000 g/m$^2$ with the apparent density of about 0.005 to about 0.7 g/cc or, preferably, a weight of about 30 to about 1,000 g/m$^2$ with the apparent density of about 0.01 to about 0.3 g/cc. The single yarn fineness of the continuous filament may be about 0.05 to about 15 deniers or, preferably, about 0.5 to about 10 deniers. The amount of the bonding component may be about 2 to about 50 wt.% or, preferably, about 4 to about 20 wt.% with respect to the total amount of the continuous filament non-woven fabric.

A process of manufacturing a continuous filament non-woven fabric according to the present invention comprises the steps of extruding through different spinning holes a high-melting point polymer and a low-melting point polymer, the difference between their respective melting points being greater than 30° C. A blended yarn web is formed by taking-off the polymers at a speed higher than 3,000 m/min. with simultaneous filament separation. Subsequently, the the blended yarn is heated up to a temperature between the respective softening points of the polymers without interlacing each with the other in order to obtain the continuous filament non-woven fabric. The high-melting point polymer is a polybutylene terephthalate polymer; the low-melting point polymer is a polyester polymer. The heat treatment is selectively of relax heat set or restricted shrinkage heat set.

According to the present invention, the high-melting point polymer used in the process of manufacturing a continuous filament non-woven fabric may have a butylene terephthalate unit greater than 70 mol %, or, preferably, greater than 90 mol %. The low-melting point polymer is preferably a crystalline polymer having butylene terephthalate unit of about 30 to about 80 mol % and a melting point of 110° to 190° C. In a preferred embodiment of the present invention, the ratio of the high-melting point polymer to the low-melting point polymer is about 98/2 to about 50/50, or more preferably, about 96/4 to about 80/20. The continuous filaments may have a single yarn fineness of about 0.05 to about 15 deniers, or, preferably, about 0.5 to about 10 deniers. The heat treatment used in the process according to the present invention can be effected during over-feeding of the web; the rate of over-feeding can be set so that the area shrinkage rate of the web becomes greater than 10%.

The present invention thus provides an improved non-woven fabric superior in bulkiness and flexibility, with substantial elimination of the disadvantages inherent in the conventional non-woven fabrics of this kind, and provides a process of manufacturing such a non-woven fabric.

BRIEF DESCRIPTION OF THE DRAWINGS

FIG. 1 is a cross-section in the direction of thickness of a non-woven fabric according to the present invention.

FIG. 2 is an enlarged cross-section in the direction of thickness of a non-woven fabric according to the present invention.

FIG. 3 is the surface of non-woven fabric according to the present invention.

DETAILED DESCRIPTION OF THE INVENTION

Figure 4A:
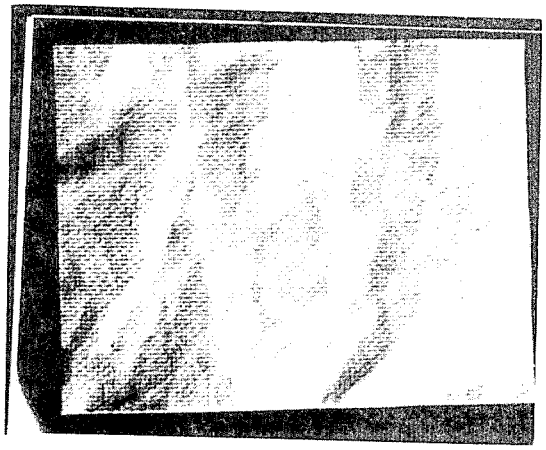
FIG. 4(A) is a section of non-woven fabric according to the present invention exemplifying the degree of residual wrinkles after compression in a cylinder.

More specifically, the invention provides a continuous filament non-woven fabric comprising continuous filaments of synthetic polymer randomly disposed so as to be laminated and bonded having an apparent density less than 0.7 g/cc under a load of 0.5 g/cm$^2$. The continuous filaments comprise a polybutylene terephthalate polymer having three-dimensional crimp of unfixed shape with a crimp extensibility greater than about 5%.

A process of manufacturing a continuous filament non-woven fabric is disclosed comprising the following steps:

(1) extruding through different spinning holes a high-melting polymer and a low-melting polymer, the difference between their respective melting points being greater than 30° C.;

(2) forming a blended yarn web by taking-off the polymers at a speed higher than about 3000 m/min., with simultaneous separation of the filaments; and (3) heating the blended yarn web up to a temperature between the respective softening points of the polymers without interlacing either with the other, which result in the continuous filament non-woven fabric according to the invention.

The high-melting point polymer is polybutylene terephthalate polymer; the low-melting point copolymeric compound is a polyester polymer. The heat treatment is selectively of relax heat set or restricted shrinkage heat set.

According to the method of manufacturing of the invention, wherein the blended yarn web is subjected to the relax heat set or the restricted shrinkage heat set, the web is shrunk by the shrinking stress of the low-melting point filaments; thus, crimp is imparted to the high-melting point filaments developing bulkiness in the web. Through sufficient heat set, the low-melting point filaments are softened for bonding and fixing under the state where the bulkiness of the web has been built up.

In the present invention, "PBT polymer", i.e., the high-melting point polymer, denotes a polymer having more than 70 mol %, preferably more than 90 mol %, of its constituent unit in the form of polybutylene terephthalate polymer. Various copolymer component may be used, such as ethylene glycol, propylene glycol, diethylene glycol, polyethylene glycol, isophthalic acid, adipic acid, sebasic acid etc. Preferably, intrinsic viscosity of the "PBT polymer" (measured in o-chlorophenol) should be 0.7–1.5. Such polymer is capable of forming flexible filaments rich in resiliency or elasticity. Furthermore, of particular importance is that such polymer is brought into a state of extremely low rigidity at temperature more than 30° C. below its melting point. In blended yarn with high shrinkage filaments, the web is shrunk even by a weak shrinking stress of the high shrinkage filaments, with consequent crimping of the PBT filaments and development of the bulkiness in the blended yarn web. Owing to the extremely rapid crystallization rate, the crystallization has almost been completed during the high speed taking-off. Through the subsequent heat set or heat treatment, both physical and chemical properties do not substantially change. In other words, despite the heat treatment at temperatures close to the melting point, undesirable deterioration or coloring is scant.

The desirable effects described above are hardly suggested when using a polyester such as polyethylene terephthalate (PET) polymer. Specifically, the PET filaments have a high rigidity, rendering difficult the development of the desired bulkiness even with heat treatment of the yarn web blended with high shrinkage filaments. Even if the bulkiness is built up somehow through raising the heat set temperatures, a hard, brittle, and discolored through deterioration non-woven fabric results.

If, however, the PBT unit in a PBT polymer to be used in the process according to the present invention is too small, disadvantages such as excessive lowering of the melting point or softening of filaments may result. This not only impairs the general applicability and stability in quality as a non-woven fabric, but additionally creates various inconveniences in the manufacturing technique.

The low-melting point polymer, a polyester polymer, preferably has a melting point lower by more than 30° C. than the high-melting point polymer and preferably should be a PBT copolymer with a melting point of about 100° to about 190° C. For the composition of such copolymer, isophthalic acid, adipic acid, ethylene glycol, polyethylene glycol, etc. are preferable, among which isophthalic acid is more preferable since it increases heat shrinkage. These polyester polymers have strong bonding properties with respect to the PBT high-melting point filaments, and also provide favorable heat shrinkage properties. More specifically, because the crystallization rate is not so fast as to complete the crystallization only by the high speed taking-off, the crystallizing property is sufficient to produce the shrinkage in the subsequent heat set. Note, however, that if the melting point falls below 110° C., the high-melting point filaments will not be sufficiently softened at the heat shrinking temperature; thus, the development of bulkiness in the blended yarn web cannot be realized. The mixing ratio of the low-melting point filaments to the total amount of continuous filament preferably is about 2 to about 50 wt.%. If the mixing ratio is less than 2 wt.%, sufficient bonding and bulkiness cannot be achieved; if the ratio is higher than 50 wt.%, the feeling or drape and appearance of the resultant non-woven fabric becomes undesirably rough and stiff. Accordingly the mixing ratio is more preferably about 4 to 20 wt.%.

The high-melting point filaments of the present invention may have any desired cross-sectional configurations, preferably cross-sections of circular, elliptic, flat, polygonal, hollow shapes. The single yarn fineness of the filaments should be less than about 15 d and preferably in a range from about 0.5 to about 10 d, since those excessively fine are difficult to subject to the high speed spinning due to yarn breakage, while those too coarse are not suitable for general applications due to lack of flexibility.

In the process of manufacturing the non-woven fabric according to the present invention, a normal practice is to simultaneously achieve the high speed taking-off and filament separation through utilization of air jet for effecting the web making, representative methods of which are disclosed, for example, in U.S. Pat. Nos. 3,338,992 and 3,707,593. The temperature of the heat set has to be in a range sufficient for softening the low-melting point filaments for bondage with the high-melting point filaments; it should not be at such a high temperature that the filament state is lost through complete melting. It is possible to simultaneously achieve the development of bulkiness and bonding with the filament configuration to a certain extent remaining. The means for the relax heat set and limited shrinkage heat set has for its object to over-feed the web continuously into the heat set zone. To achieve shrinkage also in the width-wise direction, shrinkage may take place on a smooth belt or roller; preferably, however, the web should be shrunk under a condition where it is not in contact with a supporting member. By the means described above, the web is subjected to shrinkage in area of about 10 to about 70%, preferably, of about 12 to about 50%. Setting the over-feed rate to achieve proper area shrinkage rate may be readily effected experimentally. By subsequent depression by a heat roller or the like, it is possible to smooth the surface, or to impart a suitable pattern and the like, with the proper bulkiness maintained as it is.

In the process according to the present invention, owing to an arrangement of filaments laminated in layers within the blended yarn web, the shrinkage takes place selectively with respect to the direction of the flat surface of the web, while in the direction of thickness, only the bulkiness is exclusively developed. Compared with non-woven fabrics which are interlaced by punching or water jet treatment, remarkable development of bulkiness may be anticipated in the present invention. Furthermore, since the crimp of the constituent filaments is oriented in the direction of thickness, where three-dimensional obstruction is small, the non-woven fabric of the present invention is provided with remarkable resiliency and recovery after compressions. Because the constituent filaments have stronger interference within the layers rather than between the layers, deformation in the unit of layers tends to take place; thus, the filaments are liable to be formed into lamination of a plurality of waveform or loop form layers with different phases. In such non-woven fabric, the filaments on the surface often form mushroom-like crimp to provide excellent creping to the nonwoven fabric. Under depression of the opposite faces of the non-woven fabric after the development of the bulkiness, the mushroom-like crimp becomes more conspicuous. FIG. 2 is a cross-section of one embodiment of non-woven fabric according to the present invention in which the filaments described above are combined by a binder.

In the process of manufacturing non-woven fabric according to the present invention, since the bonding is effected after the development of the crimp, the bonding point in the structure is made at random; thus, there is no possibility of it being deformed by the excessively low stress as in non-woven fabric subjected to crimp development after bonding. Therefore, the non-woven fabric of the instant invention has better stability in form.

In a preferred embodiment of the present invention, the non-woven fabric has an apparent density of about 0.01 to 0.7 g/cc, more preferably, about 0.01 to about 0.3 g/cc, and most preferably, about 0.1 to about 0.1 g/cc. Although the desired features and effects of the invention do not depend on the weight of the non-woven fabric, the practical range for such fabric is between about 10 to about 2,000 g/m$^2$, preferably, between about 30 to about 1,000 g/m$^2$. If the degree of weight or bulkiness is small, it is difficult to achieve such features as surface creping, recovery after compression, deformation, etc.

Owing to the superior strength, flexibility, bulkiness, etc. of the non-woven fabric according to the present invention, such non-woven fabric has a wide range of application to various end uses, i.e., batting of clothing items, interlining cloth, beddings, artifical leather base materials, filters, etc. Further, unique products can be developed by imparting the interlacing structure by punching, fluid jet, and the like to the non-woven fabric according to the present invention.

The following Examples are included for the purpose of illustrating the present invention without any intention of limiting the scope thereof.

EXAMPLE I

Polybutylene terephthalate (PBT) having intrinsic viscosity of 1.10 and a melting point of 224° C. and polybutylene terephthalate/isophthalate (70/30 mol %) copolymer (PBT/I) having a melting point of 174° C. were respectively fully dried for separate melting. The resultant molten polymers were supplied to one spinneret. The spinneret had 70 fine pores each 0.5 mm in diameter formed therein. The PBT was directed through 50 pores of the spinneret, while the PBT/I was directed through the remaining 20 pores for respective discharging at the rate of 1.5 g/min. per single pore.

The filaments thus extruded from the spinneret were directed towards an air aspirator disposed at a position at 100 cm below the spinneret for jetting from the aspirator under conditions in which to achieve spinning speed at 4,500 m per minute. The group of filaments thus jetted were collected onto the surface of the conveyor composed of a wire net of 30 meshes running at a position at 60 cm below said aspirator.

For separating the 70 pieces of filaments, the bundle of filaments immediately above the aspirator was charged through negative corona charging. By diffusing the filaments through an impinge plate mounted at the forward end portion of the aspirator, a uniform web was formed through lamination on the wire net. The speed of the conveyor was set to achieve a weight of fabric of about 20 g/m$^2$ to 1,000 g/m$^2$.

By directing the webs into a hot air oven maintained at 180° C. under the relax state, the thickness of the webs was increased by about 2 to 20 times that before the heat set, with variations of the area up to about 56 to about 78% and single yarn fineness from about 3.0 denier to about 3.12 denier, thus resulting in a bulky, strong, and flexible continuous filament non-woven fabric. Such bulky non-woven fabric had an apparent density of about 0.01 g/cc to about 0.06 g/cc as obtained by measuring the thickness under a load of 0.5 g/cm$^2$, and theoretical values for crimp extensibility of about 8.7 to about 28.3%, as obtained from the area shrinkage and filament shrinkage.

The apparent density is converted from the thickness. The non-woven fabric was cut into a square (10 cm × 10 cm), next, put on it a rigid plate of same size having weight of 50 g and whole thickness was measured.

One instance of the properties of the resultant non-woven fabric is as follows:

| | |
|---|---|
| Weight | 167 g/m$^2$ |
| Apparent density | 0.037 g/cc (as converted from the measured value of thickness during loading at 0.5 g/cm$^2$) |
| Strength | Longitudinal: 19.4 kg/5 cm<br>Lateral: 8.4 kg/5 cm<br>(strip method, 5 cm in width and and 10 cm in gauge length) |
| Tear strength | Longitudinal: 8.1 kg<br>(Single tongue tear method) |

-continued

| | |
|---|---|
| Bending resistance | Longitudinal: 70 mm<br>Lateral: 80 mm<br>(45° cantilever method) |
| Stretching properties | Longitudinal: 8%<br>Lateral: 12%<br>(Maximum elongation which does not produce permanent deformation, original length 10 cm × 5 cm width) |
| Crimp extensibility (theoretical value) | 18% |

FIG. 1 is a cross-section in the direction of thickness, magnified twice, of the bulky, non-woven fabric in Example I, in which filaments form the layered structure in the direction of thickness, with the crimp curving in the direction of thickness, said crimp having an extensibility of about 15%, and the phase of the crimp generally synchronized within the same layer but differentiated among the layers for enlarging spaces between the layers so as to develop the bulkiness. As can be seen from FIG. 2, an enlarged cross-section in the direction of thickness of such non-woven fabric, the low-melting point polymer component mixed therein adheres in the form of particles so as to increase the bonding strength or pulling friction of the filaments to provide high strength performance. Despite the mixed low-melting point polymer component being fused after development of the crimp to the high-melting point polymer filaments, the stretching properties and flexibility of the bulky non-woven fabric are surprisingly not impaired.

As shown in FIG. 3, the surface of such non-woven fabric, the filament crimp is characterized in the form of random development in the direction of the surface.

The bulky non-woven fabric of Example I additionally confirmed that graceful natural creping can be produced in the form of mushrooms or craters.

The bulky webs as described above are extremely superior to the conventional staple and filament non-woven fabrics in form stability and touch when applied to batting for mattresses or the like, padding for clothing items, etc. For example, the web, as is, left for a whole day and night under a load at 150 g/cm$^2$ and held in a compressed state, returned back to the original thickness after a few hours of being left to stand. Additionally, the web showed superior functionability as a filter and as various impregnation base materials. For example, in leather impregnated with urethane solution and then coagulated, not only the surface creping is utilized, but owing to the irregular structure among layers, the shrinkage degree reached as much as 20%. Further, such flexible products were rich in resiliency and completely free from paper-like feeling.

Since the bulky webs were readily subjected to heat compression molding, various effects such as dispersed adhesion of the thermoplastic granular binder, elasticity due to uneven crimping, proper cohesion force, etc. cooperated synergistically in the formation of various shaped items for the improvement of the molding processing performance.

Furthermore, the resultant bulky non-woven fabrics at the respective levels after the heat treatment were subjected to pressing by a heating emboss roller having point-like protrusions so as to achieve the apparent density of about 0.2 g/cc at 190° C. The non-woven fabrics thus processed were extremely improved in crease or wrinkle resistance as compared with the conventional item, as can be seen from a comparison of FIGS. 4(A) and 4(B).

Figure 4B:
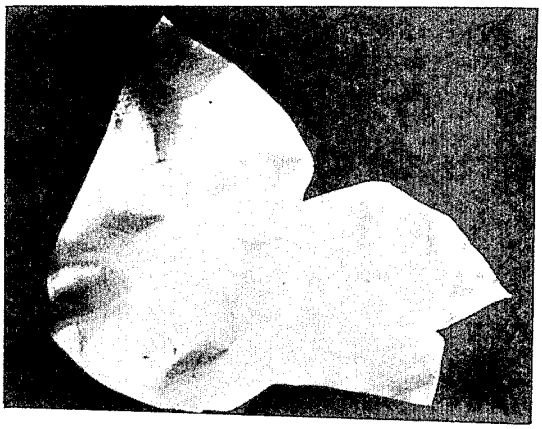
FIG. 4(B) is a section of polyethylene terephthalate non-woven fabric after compression in a cylinder.

FIGS. 4(A) and 4(B) show the degree of residual wrinkles when the non-woven fabric according to the present invention, FIG. 4(A), and the PET non-woven fabric, FIG. 4(B), prepared as described below, were rounded by hand, placed in a cylinder, compressed through application of a load, then taken out, and, finally, left as is for 10 minutes. Comparison of the two pieces gave evidence of the superior wrinkle resistance of the PBT non-woven fabric. Such wrinkle resistance is advantageous for the foundations of Japanese style or western style clothing since it provides a superior resilience as paddings for clothing items without necessity of wrinkle resistance as in the conventional ones.

The conventional non-woven fabric in FIG. 4(B) was prepared by obtaining the web with polyethylene terephthalate as the main composition and adipinic acid 20 mol % copolymer polyethylene terephthalate for the copolymer composition using the process of Example I, with further processing according to the aforementioned method in which the temperature of the emboss roller was set at 230° C.

COMPARATIVE DATA 1

By employing the same apparatus and method as in Example I, non-woven fabrics were prepared with the polymers altered. Polyethylene terephthalate having a melting point of 258° C. was adopted for the main composition, while polyethylene terephthalate/adipate (87/13 mol %) copolymer having the melting point of 221° C. was employed for the low-melting point component. The web of 150 g/m$^2$ thus collected showed no change, even when subjected to the relax heat set at 180° C. It was not only lacking in the development of bulkiness, but in the form stability at less than 0.1 kg/5 cm both in the longitudinal and lateral directions with the bonding hardly taking place. Thus, the form of the non-woven fabric could not be maintained during handling.

Although the apparent density reached 0.02 g/cc upon raising of the relax heat set temperature (along with yellowish color change of the filaments), the strength was about 0.5 kg/5 cm both in the longitudinal and lateral directions. The resultant web only had the low strength of approximately half that of the equivalent sized item according to the present invention, was very brittle, and showed a tearing strength of 0.4 kg, thus providing a hard plate-like molded item having the bending resistance over 200 mm, without any values for practical applications to batting, foundation, synthetic leather base cloth and other materials.

COMPARATIVE DATA 2

Using the same method and apparatus as in Example I, webs of 150 g/m$^2$ were prepared by employing PET for the main composition and PBT/I with a melting point of 174° C. for the low-melting point component. Although such webs were subjected to the relax heat sets at 180° C. and 240° C., no development of bulkiness was noticed. When webs were heat-treated at 240° C., strength of approximately 2 kg/5 cm both in the longitudinal and lateral directions was obtained, but the molded item was rigid and brittle, and unsuitable for practical applications.

What is claimed is:

1. A continuous filament non-woven fabric having an apparent density less than 0.7 g/cc under a load of 0.5 g/cm$^2$, (a) 50 to 98% by weight of randomly disposed continuous filaments of a polybutylene terephthalate polymer, said continuous filaments of polybutylene terephthalate polymer having a three-dimensional crimp of unfixed shape and a crimp extensibility greater than about 5%; and (b) 2 to 50% by weight of bonding component filaments of a polybutylene terephthalate co-polymer comprising about 30 to 80 mol% polybutylene terephthalate units and having a melting point at least 30° C. lower than the respective melting point of said continuous filaments;

wherein said crimp is oriented in the direction of the thickness of said fabric and the continuous filaments are laminated and bonded by means of said bonding component filaments.

2. A continuous filament non-woven fabric of claim 1 wherein said crimp is oriented in the direction of its thickness.

3. A continuous filament non-woven fabric of claim 1 wherein said continuous filaments and said bonding component have a difference between their respective melting points which is greater than 30° C.

4. A continuous filament non-woven fabric of claim 1 wherein said non-woven fabric has weight of about 10 to about 2,000 g/m$^2$, said apparent density being about 0.005 to about 0.7 g/cc.

5. A continuous filament non-woven fabric of claim 1 wherein said non-woven fabric has weight of about 30 to about 1,000 g/m$^2$, said apparent density being about 0.01 to about 0.3 g/cc.

6. A continuous filament non-woven fabric of claim 1 wherein said continuous filament has single yarn fineness of about 0.05 to about 15 deniers.

7. A continuous filament non-woven fabric of claim 6 wherein said continuous filament has single yarn fineness of about 0.5 to about 10 deniers.

8. A continuous filament non-woven fabric of claim 1 wherein the amount of said bonding component is about 4 to about 20 wt.% with respect to the total amount of said continuous filament non-woven fabric.

9. A continuous filament non-woven fabric of claim 1, wherein said continuous filaments comprise greater than about 70 mole% polybutylene terephthalate units.

10. A continuous non-woven fabric of claim 9, wherein said continuous filaments comprise greater than about 90 mole% polybutylene terephthalate units.

11. A process of manufacturing a continuous filament non-woven fabric, comprising;

(a) extruding through different spinning holes a high-melting polymer and a low-melting polymer having a difference between their respective melting points greater than 30° C.;

(b) forming a blended yarn web by taking off said polymers at a speed higher than 3000 m/min, with simultaneous filament separation; and (c) heating the thus blended yarn web up to a temperature between the softening points of said polymers without interlacing each with the other to obtain the continuous filament non-woven fabric, wherein said high melting point polymer is continuous filaments of a polybutylene terephthalate comprising from 50 to 98% by weight of the continuous filament non-woven fabric, said polymer being randomly disposed and having an apparent density of less than 0.7 g/cc under a load of 0.5 g/cc$^2$, wherein said low-melting point polymer is continuous filaments of a polyester polymer comprising 2 to 50% by weight of the continuous filament non-woven fabric, said polyester polymer comprising about 30 to about 50 mole% polybutylene terephthalate units and having a melting point from 110° to 190° C., and wherein the heating of the web is selectively a relax heat set or a restricted shrinkage heat set.

12. A process of manufacturing a continuous filament non-woven fabric of claim 11 wherein said high-melting point polymer comprises a butylene terephthalate unit greater than about 70 mol %.

13. A process of manufacturing a continuous filament non-woven fabric of claim 12 wherein said high-melting point polymer comprises a butylene terephthalate unit greater than about 90 mol %.

14. A process of manufacturing a continuous filament non-woven fabric of claim 11 wherein said low-melting point polymer is a crystalline polymer comprising a butylene terephthalate unit of about 30 to about 80 mol % and a melting point from 110° to 190° C.

15. A process of manufacturing continuous filament non-woven fabric of claim 11 wherein the ratio of the high-melting point polymer to the low-melting polymer is about 98/2 to about 50/50.

16. A process of manufacturing a continuous filament non-woven fabric of claim 11 wherein said continuous filaments have a single yarn fineness of about 0.05 to about 15 deniers.

17. A process of manufacturing a continuous filament non-woven fabric of claim 16 wherein said continuous filaments have single yarn fineness of about 0.5 to about 10 deniers.

18. A process of manufacturing a continuous filament non-woven fabric of claim 11 wherein said heat treatment is effected during over-feeding of said web.

19. A process of manufacturing a continuous filament non-woven fabric of claim 18 wherein the rate of said over-feeding is set so that the area shrinkage rate of said web becomes higher than about 10%.

20. A process of manufacturing a continuous filament non-woven fabric of claim 11 wherein the ratio of the high-melting point polymer to the low-melting point polymer is about 96/4 to about 80/20.

21. A process of manufacturing a continuous filament non-woven fabric of claim 11, wherein said continuous filaments of polybutylene terephthalate polymer have a three-dimensional crimp of unfixed shape and a crimp extensibility of greater than 5%.

* * * * *